US005105860A

United States Patent [19]

Connor

[11] Patent Number: 5,105,860

[45] Date of Patent: Apr. 21, 1992

[54] APPARATUS FOR DRAINING FLUID CONTAINERS

[76] Inventor: Annette B. Connor, 41 Pinewood Dr., Somersworth, N.H. 03878

[21] Appl. No.: 621,722

[22] Filed: Nov. 30, 1990

[51] Int. Cl.[5] ..... B67C 11/00

[52] U.S. Cl. ..... 141/106; 141/364; 141/375; 141/369

[58] Field of Search ..... 141/106, 363, 364, 365, 141/366, 367, 369, 375; 222/108

[56] References Cited

U.S. PATENT DOCUMENTS

| | | | |
|---|---|---|---|
| 162,998 | 5/1875 | Collison | 141/364 |
| 478,303 | 7/1892 | Allgood | 141/106 |
| 1,742,150 | 12/1979 | Rollins | 141/106 X |
| 2,320,159 | 5/1943 | Smith | 141/106 |
| 3,230,986 | 1/1966 | Worley | 141/375 |
| 3,615,150 | 10/1971 | Indrunas | 141/375 |
| 3,643,704 | 2/1972 | Carr | 141/106 |
| 3,860,048 | 1/1975 | White | 141/375 |
| 4,207,933 | 6/1980 | Howson | 141/106 |
| 4,832,095 | 5/1989 | Bonnell | 141/106 |

*Primary Examiner*—Ernest G. Cusick
*Attorney, Agent, or Firm*—William B. Ritchie

[57] ABSTRACT

An apparatus for draining viscous fluids to the cap-ends of various sizes and shapes of containers without shaking or tapping the containers to hasten the process. The apparatus has three openings within a base having varying diameters, depths and shapes to accommodate containers of varying dimensions. For draining uncovered containers, a catch drawer is provided for two of the opening sets. A third opening set is provided for smaller bottles that are to be drained with caps left in place, such as personal care items. The apparatus can be molded from plastic to make it food-safe and dishwasher safe for easy cleaning.

5 Claims, 4 Drawing Sheets

APPARATUS FOR DRAINING FLUID CONTAINERS

BACKGROUND OF THE INVENTION

1. Field of the Invention

The invention relates to container draining devices.

2. Description of the Related Art

A household problem for the consumer is removing thick, concentrated liquids from the bottom of containers which have been standing upright for several hours or many days. Many liquid concentrates need to remain at an undiluted state for proper measure or use, e.g. undiluted automatic dish washing detergent, sauce-like food items such as ketchup and salad dressings as well as personal care items such as shampoos, hair conditioners and body lotions. Such liquids drain very slowly to the end opening often causing the consumer to discard a useful amount of liquid.

Due to their configuration, most containers do not easily stand alone on the cap-end in an inverted position allowing drainage; standing alone, inverted containers usually topple over. Attempting to support inverted containers against other containers, a counter top wall or other 'structure', usually proves unsatisfactory. The inverted container either slips down onto its side or leans at an angle which does not provide for maximum drainage to the cap-end of the container.

U.S Pat. Nos. 3,615,150 issued to Indrunas and 3,230,986 issued to Worley, disclose ketchup draining devices. These devices are specifically directed to draining one ketchup bottle into another.

U.S. Pat. No. 3,860,048 issued to White, discloses a bottle draining rake that has a pair of supporting arms to hold bottles and a base with 'sockets' to hold a container which is filled via a funnel. The configuration of the supporting arms of this design is directed towards holding containers of conventional bottle-shape.

U.S. Pat. No. 4,207,933 issued to Howson discloses a bottle draining device which provides bottles to be supported above another container which serves to collect the contents via a funnel. Both devices' use is limited to bottles of a particular size and configuration.

A device with a plurality of openings in which various sized containers can be supported while draining is not found in the prior art.

SUMMARY OF THE INVENTION

It is an object of the invention to provide a device that will support containers in an inverted position to permit gravity flow of thick, concentrated liquids to the cap-end of the container.

It is still another object of the invention to provide a device that will support fluid-filled containers of various sizes and configurations.

It is still another object of the invention to provide a method of removing and storing the remaining contents of various sized containers through the use of an auxiliary 'catch drawer'.

It is still another object of the invention to provide a device that can be easily stored during and after use.

It is still another object of the invention to provide a method of draining liquids from containers that does not require shaking, tapping or otherwise attending to the container while it is being drained.

It is still another object of the invention to provide a device that is washable and food-safe.

The invention is an apparatus for draining a plurality of container sizes, shapes, and cap-end dimensions by holding said container in an inverted position at the cap-end to drain the viscous fluid contents therein. The apparatus comprises a base having at least one set of contiguous cylindrical openings, nested in decreasing diameters from largest to smallest and sized to releasably fit the cap-end of said container. The base is adapted in size to permit the container to rest in a stable inverted position to permit the contents to drain towards the cap-end under the influence of gravity.

DETAILED DESCRIPTION OF THE DRAWINGS

DETAILED DESCRIPTION OF THE INVENTION

Figure 1:
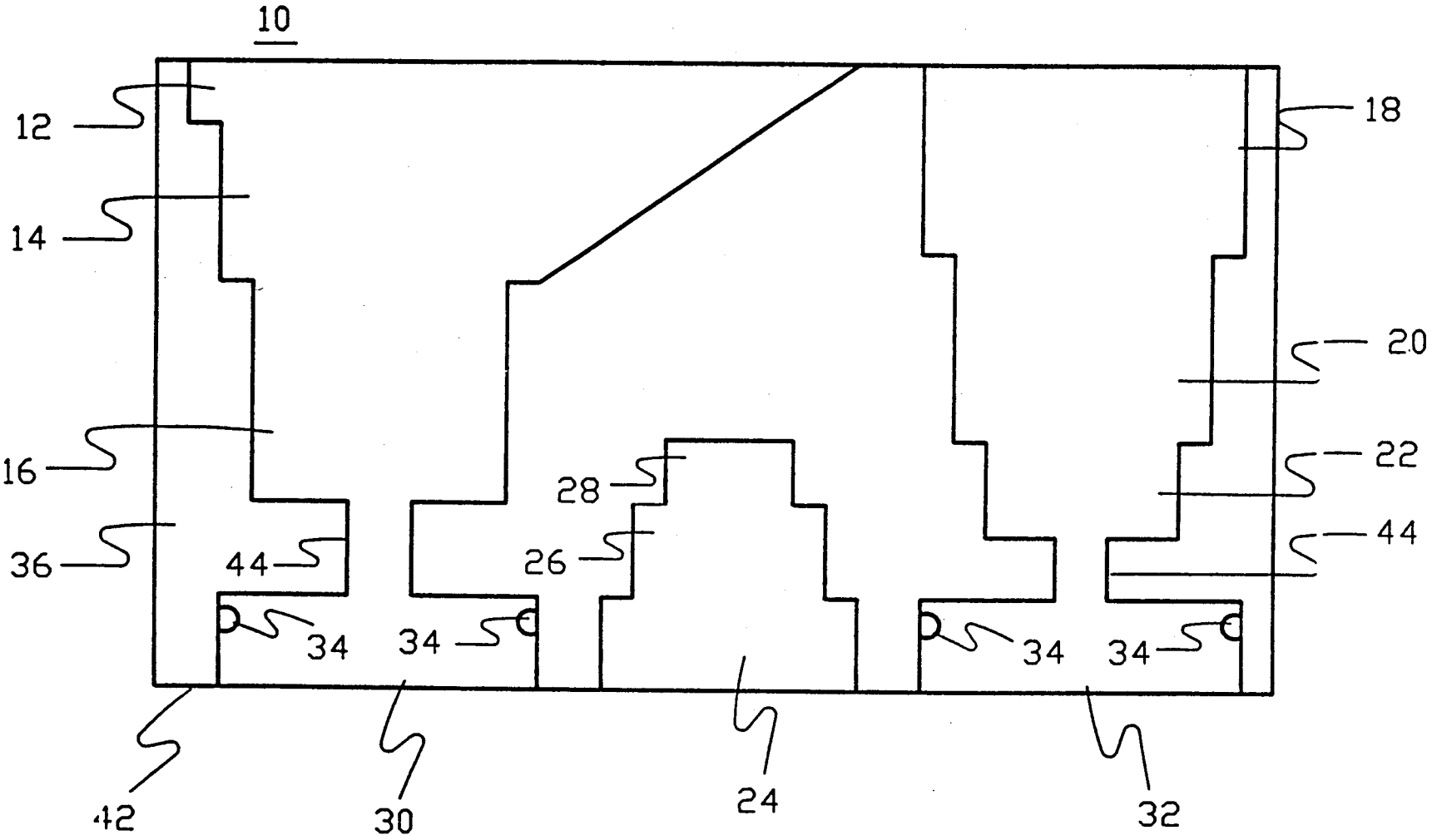
FIG. 1 is a cross-sectional view of the apparatus according to the invention.

FIG. 1 is a cross-sectional view of the apparatus according to the invention. Invention 10 would preferably be manufactured from washable and food-safe plastic. However, other materials would also be suitable including metal, e.g. aluminum.

Base 36 containing the openings that will support various sizes of containers would be preferably molded from a single piece of plastic. However, fabrication using several acrylic parts would also be suitable if found to be as cost effective.

Base 36 is preferably about 8 inches long, 4.5 inches wide and 4.5 inches deep. While these dimensions are not critical, it is important that base 36 be sized to permit holding large containers such as laundry detergent containers in an stable inverted postion.

Base 36 is provided with three sets of nested openings, two on top surface 40, one on bottom surface 42, in alignment on a common axis to accommodate various sized containers. A contoured opening set for the largest and irregular-shaped containers comprises top opening 12, middle opening 14, and bottom opening 16. Top opening 12 is preferably ½ inch deep and 3¼ in diameter flaring to approximately 5 inches at the widest point. Middle opening 14 is preferably 1¼ inches deep and 2¾ inches in diameter flaring to 4 inches at the widest point. Bottom opening 16 is preferably 1⅜ inches deep and 2 inches in diameter.

A cylindrical opening set for more regular-shaped bottles comprises top opening 18, middle opening 20 and bottom opening 22. Opening 18 is preferably 2 inches in diameter and 1½ inches deep. Opening 20 is preferably 1¾ inches in diameter and 1 inch deep. Opening 22 is preferably 1½ inches diameter and 1 inch deep.

The fluid that is drained from containers placed in the contoured opening set can be collected in a rectangular-shaped drawer (not shown in FIG. 1, but visible in FIG. 4) adapted to fit in drawer opening 30. Drawer opening 30 is preferably 2½ inches wide, approximately ¾ inches high and 4¼ inches deep. Fluid collected from the contoured opening set is drained into the drawer via conduit 44. The drawer is removably attached to base 36 via rails 34 which can be integrally molded. Similarly, fluid collected from a container placed in the cylindrical set of openings can be drained via conduit 44 to a drawer having approximately the same dimensions and the same method of releasably attaching in drawer opening 32.

An auxiliary set of openings is provided on bottom surface 42 of base 36. This set is useful for small bottles where the collected fluid can be retained in the closed container at the cap-end, e.g. shampoo, hand lotion/-cream.

The auxiliary opening set comprises top opening 28, middle opening 26 and bottom opening 24. Top opening 28 is preferably ⅞ inches in diameter and ½ inch deep. Middle opening 26 is preferably 1¼ inches in diameter and ½ inch deep. Bottom opening 24 is preferably 1¾ inches in diameter and 1 inch deep.

Figure 2:
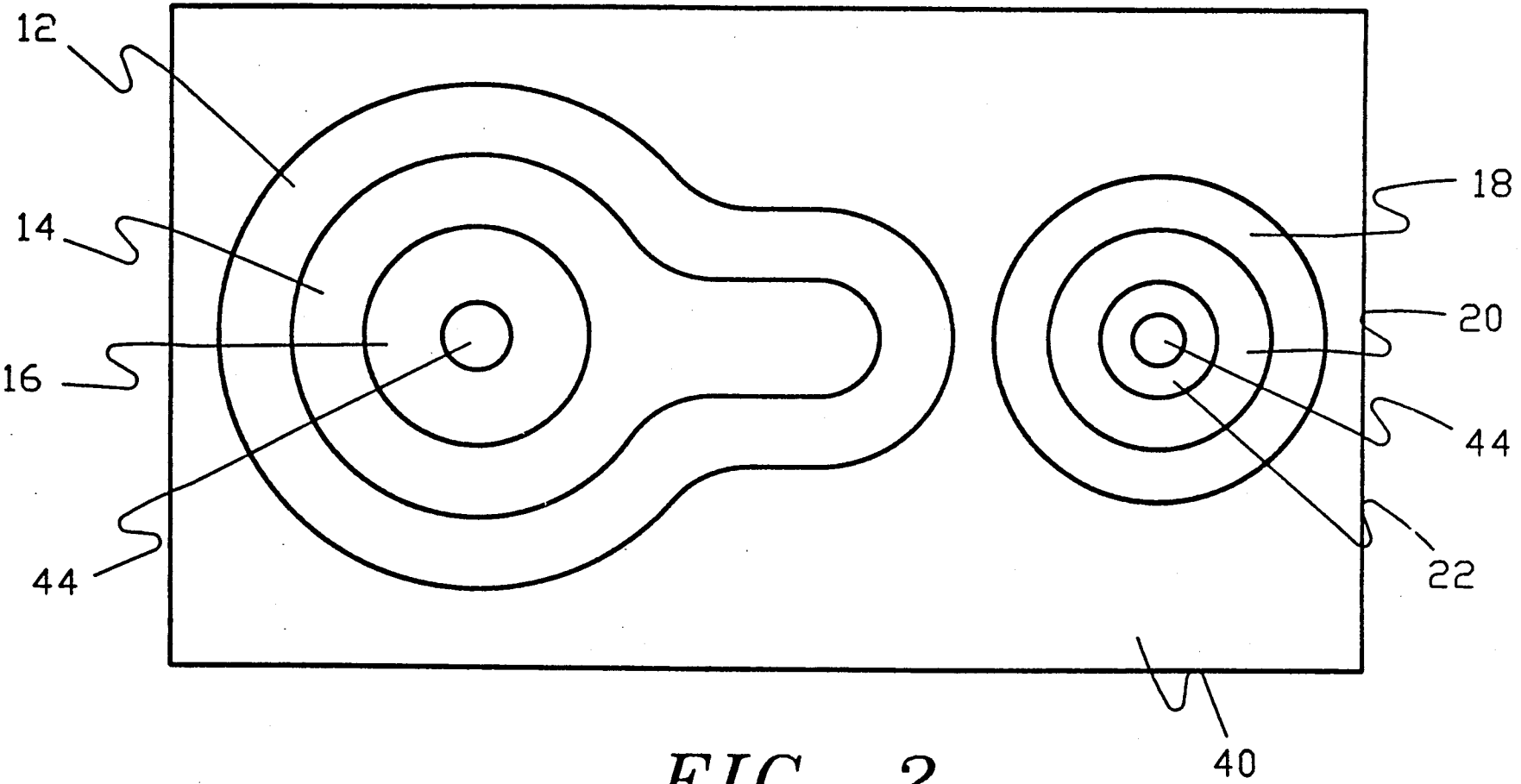
FIG. 2 is a top view of the apparatus according to the invention.

FIG. 2 is a top view of the apparatus according to the invention. The contoured opening set and the cylindrical opening set are shown with the center of the diameters of the various openings coincident with one another within the respective sets. Opening 12 and 14 are provided with a key-hole shape to accommodate irregular sized containers having handles such as large laundry detergent containers.

Drainage conduit 44 is shown as being centered, however, a centered placement is not critical to invention 10. An alternative embodiment would have conduit 44 as a funnel-shaped drainage hole to facilitate collecting fluid in the drawer below.

Figure 3:
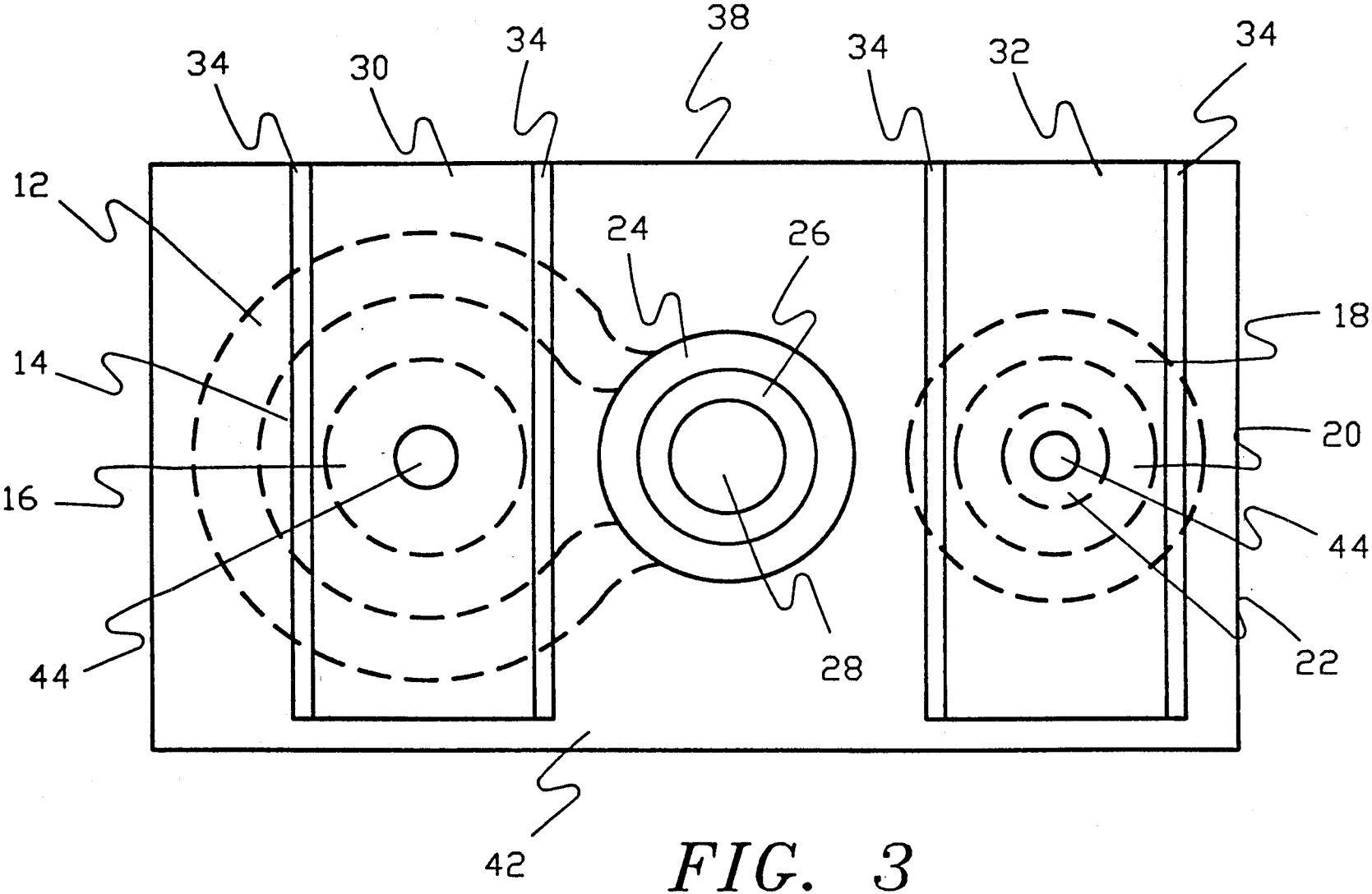
FIG. 3 is a bottom view of the apparatus according to the invention.

FIG. 3 shows a bottom view of invention 10. The auxiliary opening set on bottom surface 42 are shown with openings 24, 26 and 28 nested with the centers of the openings in alignment on a common axis. Drawer openings 30 and 32 are open to front surface 38. Rails 34 are used to support the rectangular-shaped catch drawers (not shown) that fit within the openings.

Figure 4:
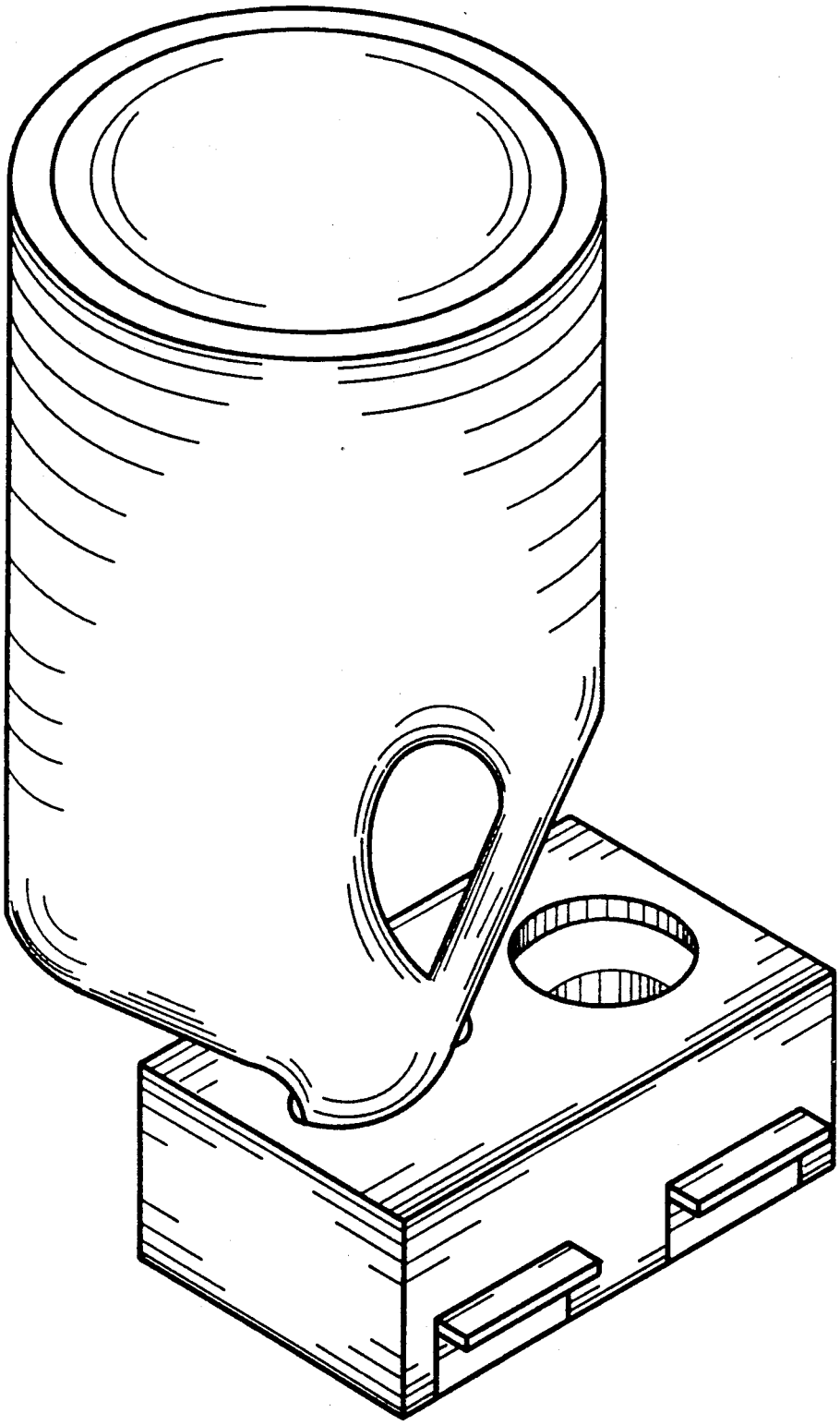
FIG. 4 illustrates a typical container being drained according to the invention.

FIG. 4 illustrates a typical large container being drained in the contoured shaped openings. In operation, a container may be drained with the cap left in place. The contents could then be recovered by leaving the container inverted and carefully removing the cap to obtain the fluid. An alternative embodiment would be to construct the apparatus without the drawers or drainage conduits and simply rely on draining the containers with caps in place.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An apparatus for draining containers of differing sizes and shapes comprising:

a rectangular base, having a top and bottom, adapted in size to support said containers in a stable inverted position while draining;

a first drainage access disposed in the top of said base, adapted to support irregular shaped containers with integral handles, said first drainage access having a plurality of concentric, contiguous plurality of openings, said openings nested from largest to smallest, with the largest of said plurality of openings at the top of said base and the smallest towards the bottom of said base, and at least the largest of said plurality of openings having a key-hole shape adapted to support irregular shaped containers with integral handles.

2. The apparatus of claim 1 further comprising:

a second drainage access disposed in the top of said base, adapted to support containers having substantially round cross-sectional shapes, said second drainage access having a second plurality of concentric, contiguous openings, said openings nested from largest to smallest, with the largest of said second plurality of openings at the top of said base and the smallest towards the bottom of said base.

3. The apparatus of claim 2 further comprising:

a first catch drawer, slidably held within said base, aligned beneath said first drainage access to collect the contents of the container supported in said first drainage access being drained.

4. The apparatus of claim 3 further comprising:

a second catch drawer, slidably held within said base, aligned beneath said second drainage access to collect the contents of the container supported in said second drainage access being drained.

5. The apparatus of claim 4 further comprising:

a third drainage access disposed in the bottom of said base, adapted to support the caps of containers, said third drainage access having a third plurality of concentric, contiguous openings, said third plurality of openings nested from largest to smallest, with the largest of said third plurality of openings at the bottom of said base and the smallest towards the top of said base.

* * * * *